US012196527B2

(12) United States Patent
Angers, Jr.

(10) Patent No.: US 12,196,527 B2
(45) Date of Patent: Jan. 14, 2025

(54) FORWARD CHARGING HANDLE FOR FIREARM AND METHOD THEREFORE

(71) Applicant: John W Angers, Jr., Youngsville, LA (US)

(72) Inventor: John W Angers, Jr., Youngsville, LA (US)

( * ) Notice: Subject to any disclaimer, the term of this patent is extended or adjusted under 35 U.S.C. 154(b) by 20 days.

(21) Appl. No.: 17/886,277

(22) Filed: Aug. 11, 2022

(65) Prior Publication Data

US 2024/0053119 A1 Feb. 15, 2024

(51) Int. Cl.

| | |
|---|---|
| ***F41C 7/02*** | (2006.01) |
| ***F41A 3/72*** | (2006.01) |
| ***F41C 23/16*** | (2006.01) |

(52) U.S. Cl.

CPC ..... *F41C 7/02* (2013.01); *F41A 3/72* (2013.01); *F41C 23/16* (2013.01)

(58) Field of Classification Search

CPC .... F41A 3/72; F41A 35/06; F41C 7/02; F41C 23/16

See application file for complete search history.

(56) References Cited

U.S. PATENT DOCUMENTS

| | | | |
|---|---|---|---|
| 2,752,826 | A | 7/1956 | Simpson |
| 3,225,653 | A | 12/1965 | Packard |
| 3,686,998 | A | 8/1972 | Seifried |
| 3,774,498 | A | 11/1973 | Moller et al. |
| 3,999,461 | A | 12/1976 | Johnson et al. |
| 4,020,741 | A | 5/1977 | Junker |
| 4,244,273 | A | 6/1981 | Langendorfer, Jr. et al. |
| 4,389,920 | A | 6/1983 | Dufour, Sr. |
| 4,827,652 | A | 5/1989 | Martin |
| 4,867,039 | A | 9/1989 | Dobbins |
| 6,311,603 | B1 | 11/2001 | Dunlap |
| 6,722,255 | B2 | 4/2004 | Herring |

(Continued)

FOREIGN PATENT DOCUMENTS

| | | |
|---|---|---|
| EP | 2141436 A2 | 1/2010 |

OTHER PUBLICATIONS

USPTO, Office Action for Utility U.S. Appl. No. 13/965,935 dated Jun. 26, 2014, Inventor Greg Donahue.

(Continued)

*Primary Examiner* — Gabriel J. Klein

(74) *Attorney, Agent, or Firm* — JOSEPH T REGARD, LTD PLC

(57) ABSTRACT

A device and method for charging an automatic or semi-automatic firearm, via a unique forward charging handle configuration. The present invention is illustrated and for use on the AR-15 rifle platform, but is equally applicable to various other caliber and configured firearms, with or without gas tubes. The forward charging handle slidably reciprocates about and along the frontal support or hand guard area (also referenced as the fore stock) in a pump action, allowing ejecting of spent, jammed or dud ammo from the chamber area, or initial chambering or charging the firearm while maintaining shooting position. The present invention is particularly suitable for use in competitive shooting, military applications, hunting, etc, allowing the user to charge, chamber, and/or unjam the firearm while maintaining firing posture, without the need for the user's hand leaving the front support.

10 Claims, 12 Drawing Sheets

(56) References Cited

U.S. PATENT DOCUMENTS

| | | | | |
|---|---|---|---|---|
| 7,231,861 | B1 | 6/2007 | Gauny | |
| 7,240,600 | B1 | 7/2007 | Bordson | |
| 7,798,045 | B1 | 9/2010 | Fitzpatrick et al. | |
| 8,156,854 | B2 | 4/2012 | Brown | |
| 8,161,864 | B1 | 4/2012 | Vaksanovich | |
| 8,210,089 | B2 | 7/2012 | Brown | |
| 8,210,090 | B2 | 7/2012 | Brown | |
| 8,468,929 | B2 | 1/2013 | Larson et al. | |
| 8,561,517 | B2 | 10/2013 | Brown | |
| 8,567,301 | B1 | 10/2013 | Sharron | |
| 8,667,883 | B1 | 3/2014 | Larson et al. | |
| 8,863,632 | B1 | 10/2014 | O'Malley | |
| 8,897,620 | B2 | 11/2014 | Sato et al. | |
| 8,899,138 | B2 | 12/2014 | Brown | |
| 9,003,686 | B2 | 4/2015 | Brown | |
| 9,109,848 | B2 | 4/2015 | Brown | |
| 9,032,860 | B2 | 5/2015 | Faxon | |
| 9,134,082 | B2 | 9/2015 | Brown | |
| 9,188,401 | B2 | 11/2015 | Pizano | |
| 9,541,339 | B2 | 1/2017 | Orne, III et al. | |
| 9,638,481 | B1 * | 5/2017 | Marano | F41A 3/72 |
| 10,113,830 | B2 | 10/2018 | Monveldt et al. | |
| 10,345,059 | B2 | 7/2019 | Gibbens et al. | |
| 10,352,635 | B2 | 7/2019 | Noonan | |
| 10,393,456 | B1 | 8/2019 | Beardsley | |
| 10,598,451 | B1 | 3/2020 | Haidu | |
| 11,105,571 | B2 | 8/2021 | Noonan | |
| 11,105,572 | B1 | 8/2021 | Lee | |
| 11,112,199 | B2 | 9/2021 | Pizano | |
| 2010/0000400 | A1 * | 1/2010 | Brown | F41G 1/02 42/111 |
| 2012/0018647 | A1 | 7/2012 | Dublin | |
| 2013/0284008 | A1 | 10/2013 | Pizano | |
| 2014/0060294 | A1 | 3/2014 | Brown | |
| 2014/0068988 | A1 | 3/2014 | Donahue et al. | |
| 2014/0259843 | A1 | 9/2014 | Matteson | |
| 2015/0089854 | A1 * | 4/2015 | Findlay | F41A 3/38 42/20 |
| 2015/0113848 | A1 | 4/2015 | Monveldt et al. | |
| 2015/0192376 | A1 | 7/2015 | Dickenson | |
| 2016/0349001 | A1 * | 12/2016 | Troy | F41A 35/06 |
| 2018/0142975 | A1 * | 5/2018 | Hoon | F41A 3/66 |
| 2018/0195820 | A1 * | 7/2018 | Noonan | F41C 23/16 |
| 2019/0154382 | A1 * | 5/2019 | Pizano | F41A 19/47 |
| 2019/0212081 | A1 * | 7/2019 | Cox | F41C 7/02 |
| 2020/0080802 | A1 | 3/2020 | Jennings | |
| 2021/0180896 | A1 | 6/2021 | Noonan et al. | |
| 2021/0348862 | A1 | 11/2021 | Noonan et al. | |
| 2022/0146219 | A1 | 5/2022 | Noonan et al. | |

OTHER PUBLICATIONS

USPTO, Office Action for Utility U.S. Appl. No. 16/283,757 dated Dec. 20, 2019, Inventor Brandon Paul Jennings.

* cited by examiner

FORWARD CHARGING HANDLE FOR FIREARM AND METHOD THEREFORE

GENERAL FIELD OF THE INVENTION

The present invention relates to devices and methods for charging an automatic or semi-automatic firearm, via a unique forward charging handle configuration. The present invention is illustrated for use on the AR-15 rifle platform, but is equally applicable to various other caliber and configured firearms. The forward charging handle slidably reciprocates about and along the frontal support or hand guard area (also referenced as the fore stock) in a pump action, to facilitate ejection of spent, jammed or dud ammo from the chamber area, or initial chambering or charging the firearm while maintaining shooting position. The present invention is particularly suitable for use in competitive shooting, military applications, hunting, law enforcement, etc, allowing the user to charge, chamber, and/or unjam the firearm while maintaining firing posture, without the need for the user's hand leaving the front support.

GENERAL BACKGROUND

Semi-Automatic and automatic firearms having longitudinally reciprocating bolts such as (but not limited to) AR-15's, M-16's or the like generally require a charging mechanism to initially chamber a load from the magazine to the firing chamber, or clear a missfire, failure to fully recoil after firing, or jam, generally in the form of the charging handle configured to retract the bolt carrier assembly, with the first end comprising a handle situated at the rear of the upper receiver, and a second end engaging the bolt carrier assembly.

In use, the user is required to grasp the handle and pull same to retract the bolt carrier assembly fully retracted from the chamber, then release so that spring bias urges the bolt carrier forward. The retraction removes any shell casing (or unspent round) from the chamber and, if a magazine with ammo is in place, such an action can be used to chamber a round.

While this typical charging handle configuration can be effective to charge the firearm, its position and use can be less than ideal, as it can be difficult if not impossible to accomplish while maintaining firing posture. Typically in use, the user would have to lower the firearm from firing position to a charging position, at which point one would, for example, ungrip the forward stock or hand guard to grasp the charging handle, and, with the other hand grasping the carry handle, grip, or rear stock, etc, depending on the configuration, pull the charge handle, then, once charged, reposition from the charging position back to the firing position.

Accordingly, if during use the firearm requires charging, for example due to failure to fully recoil after firing, or jamming, dud, or incomplete cycling of spent ammo, manually charging via the above discussed system can result in a significant interruption of use due to required repositioning from the firing position to the charging position, then back to the firing position. This delay could endanger one using the firearm for protection or in a military or law enforcement capacity, or result in significant performance loss in a competitive shooting, or hunting scenario.

GENERAL SUMMARY DISCUSSION OF THE INVENTION

Unlike the prior charging systems, which generally provided a rearwardly-situated charging handle, the present invention provides a unique, forward charging handle configuration, wherein there is provided a forward charging handle assembly configured to slidably engage about and reciprocate along the frontal support or hand guard area (also referenced as the fore stock) so as to provide a pump action to fully recoil the bolt to facilitate ejection of spent, jammed or dud ammo from the chamber area, or facilitate initial chambering or charging the firearm, all the while maintaining shooting position.

The present invention thereby provides a significant reduction in time and effort spent charging the firearm with nominal interruption of ability to maintain firing position, which proves particularly suitable for use where time is of the essence such as competitive shooting, military or law enforcement operations, hunting, etc, with the user able to charge, chamber, and/or unjam the firearm while maintaining firing posture, in a fraction of the time required for conventional systems, and without the need for the user's hand to ungrip the front support.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein:

FIG. 1 is an exploded, forward perspective view of the forward charging unit for gas operated carbines of the present invention requiring a gas tube, the illustrated configuration particularly suitable for use with AR-15 style rifles or the like.

FIG. 8 is an exploded, forward perspective view of an alternative forward charging unit of the present invention, the illustrated embodiment particularly suitable for use with a pistol caliber carbine or the like.

DETAILED DISCUSSION OF THE INVENTION

Figure 1:
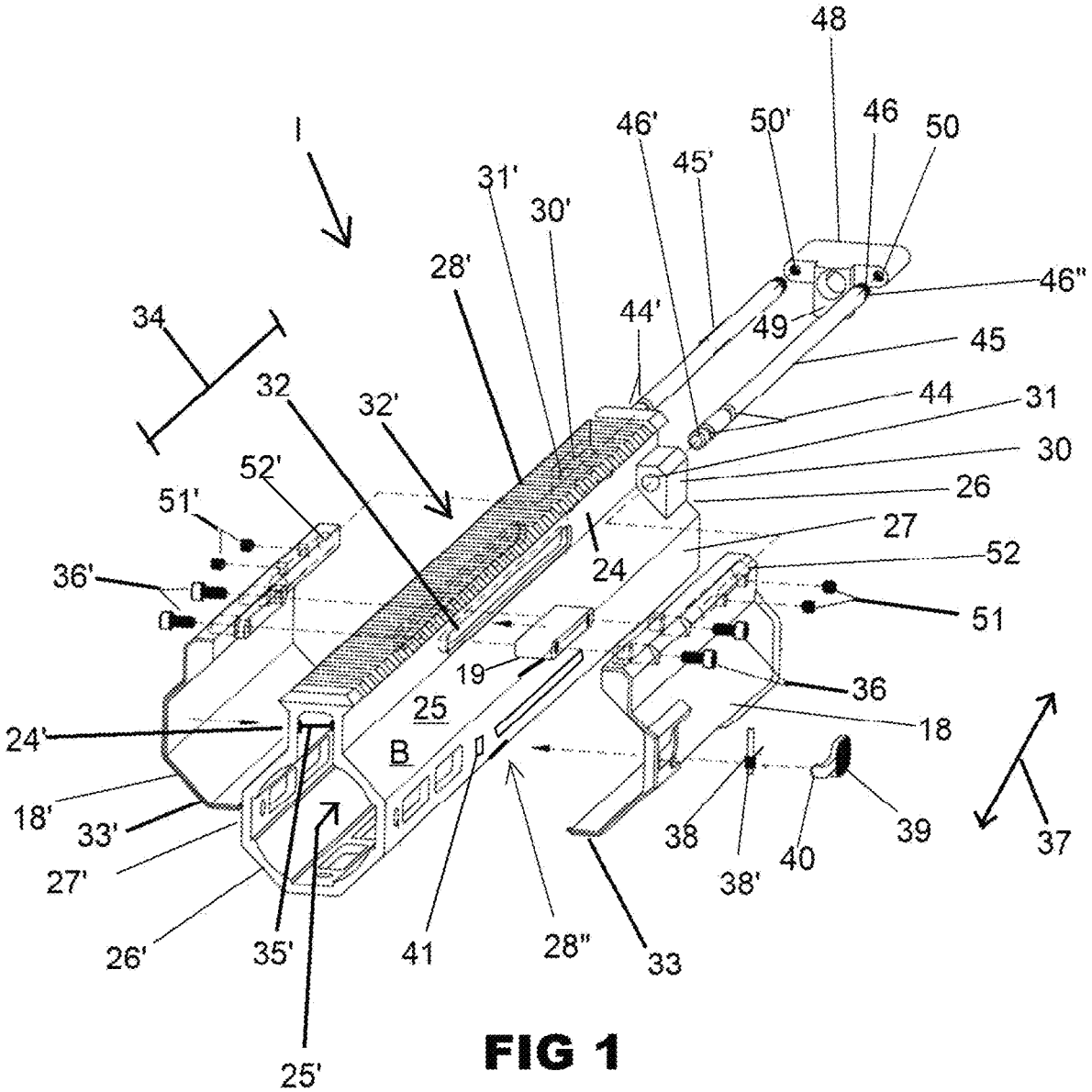
Figure 2:
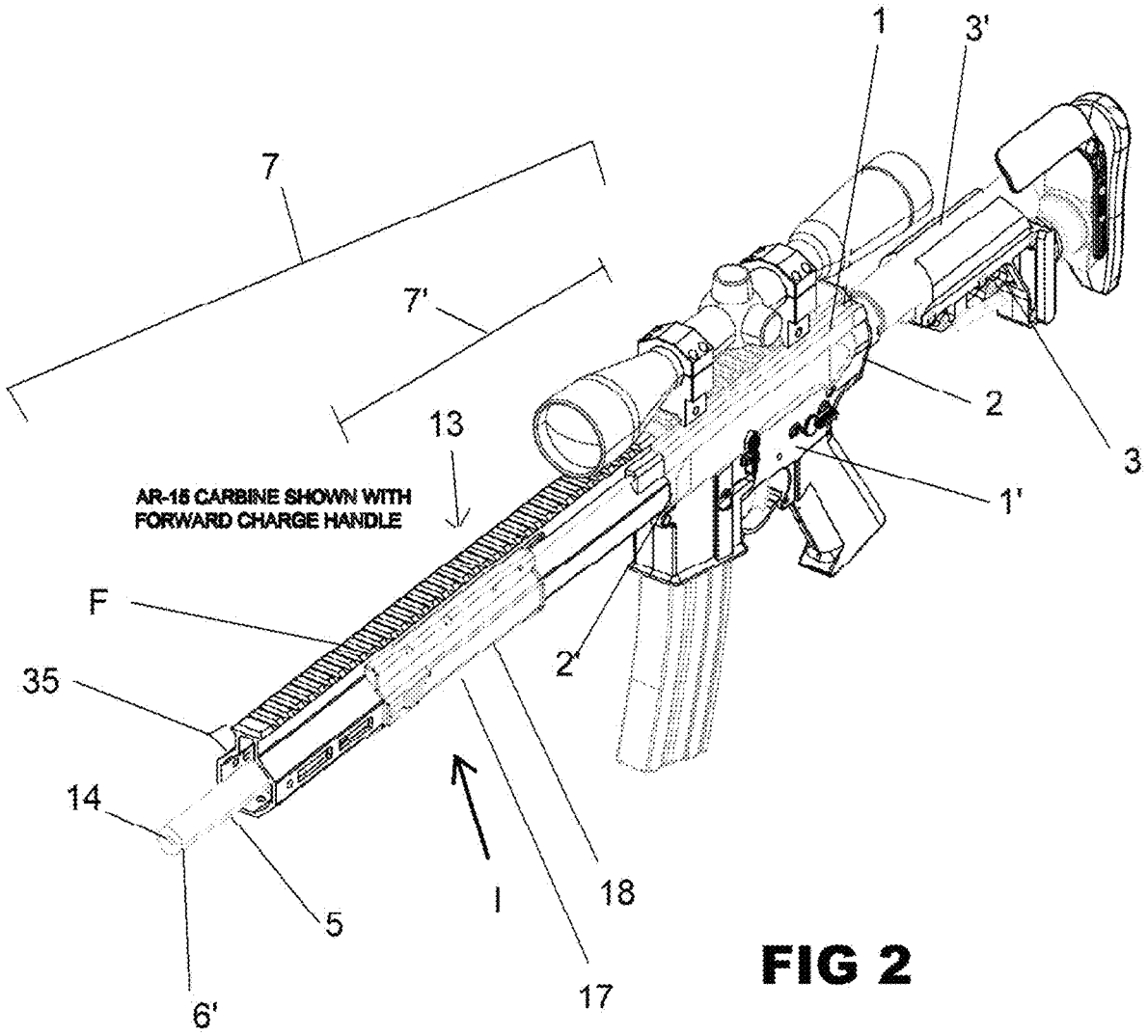
FIG. 2 is a forward, perspective view of the invention of FIG. 1, as applied to a AR-15 rifle.
Figure 3:
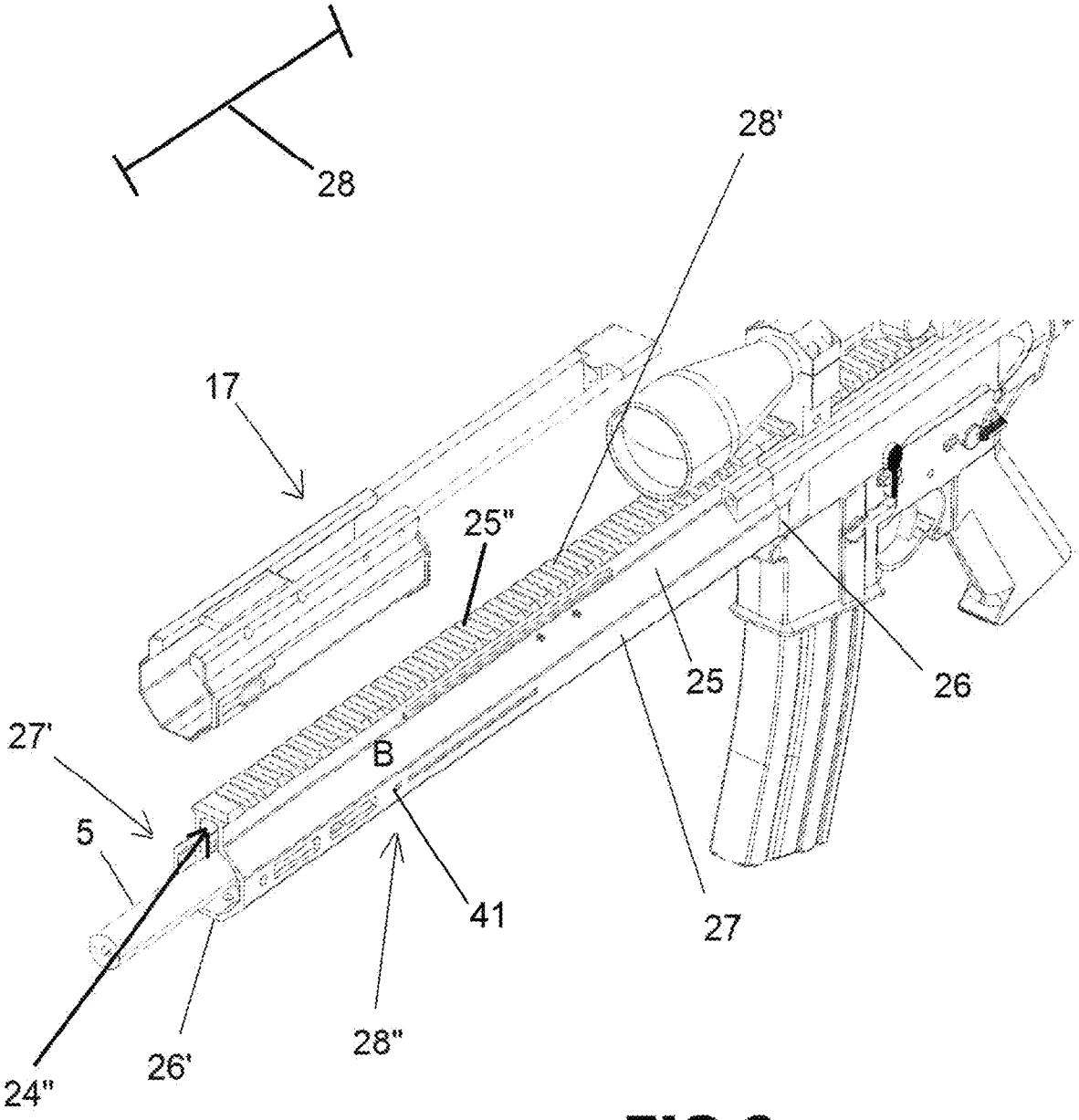
FIG. 3 is a forward, partial, perspective view of the invention of FIG. 2 illustrating the handguard applied to the AR-15 with the charging handle, drive stem and BCG catch of the present invention illustrated separately prior to installation.
Figure 6:
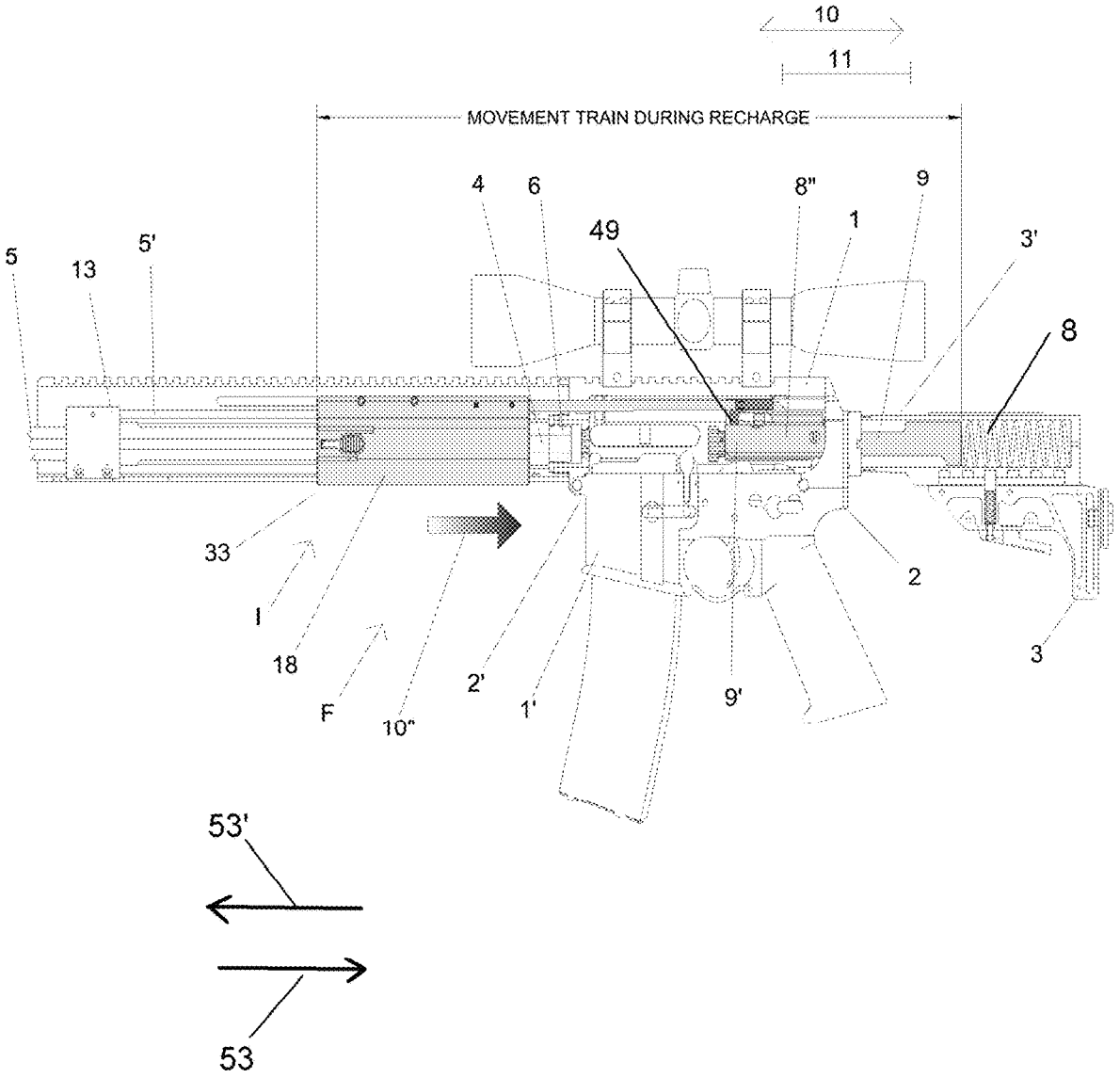
FIG. 6 is a side view of the invention of FIG. 3 in assembled form in use, showing movement of the charge train during a recharge cycle, wherein the bolt is positioned to its fully retracted position.
Figure 7:
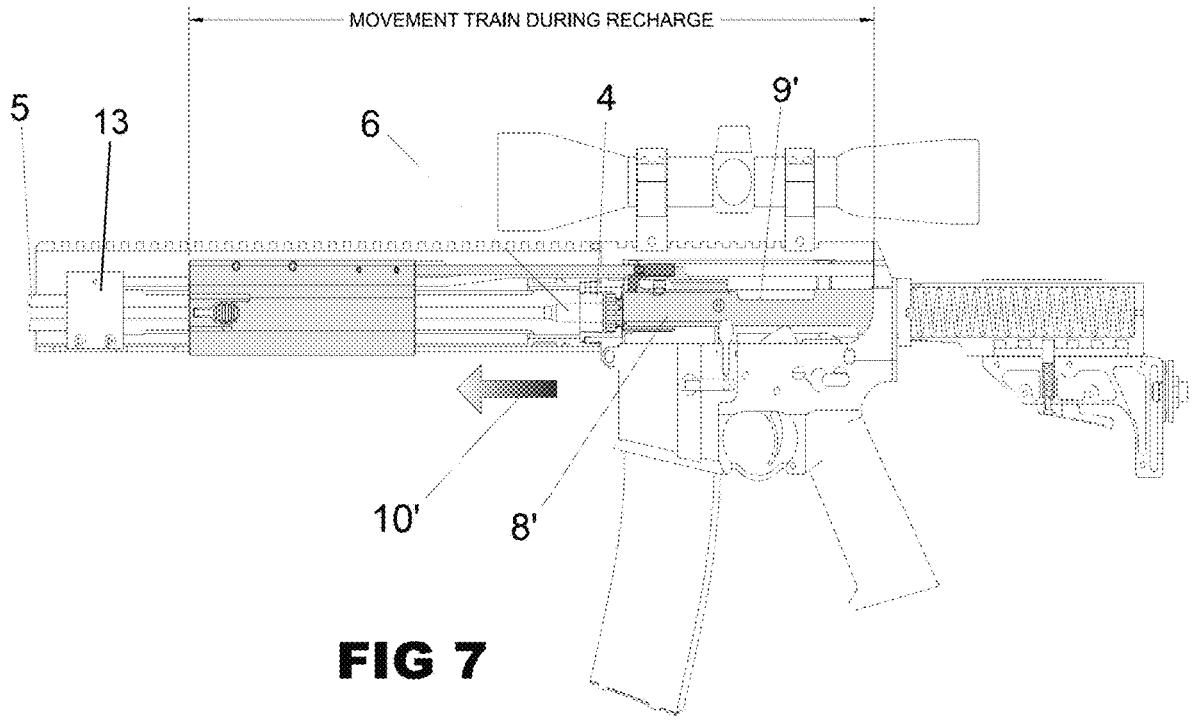
FIG. 7 is a side view of the invention of FIG. 6, instead showing movement of the charge train from the fully retracted position, urged via spring bias to the fully charged position with the bolt at the chamber.

Referring to FIGS. 1, 2, 3, 6 and 7, the preferred embodiment I of the present invention is configured for mounting to and use with a gas-operated, carbine-type firearm F using a gas tube as part of its operation, such as an AR15, M16 etc. As shown, the firearm illustrated has a lower receiver 1' and upper receiver 1. Each receiver 1, 1' has first 2, 2' and second ends, the first end 2 of lower receiver 1' having mounted thereto the tang or buffer tube 3' for a rear stock 3 (or other configuration, depending on type), the second end 2' of upper receiver 1 engaging a firing chamber 4 at the first end 6 of a barrel 5, the barrel 5 further comprising a second end 6' and a length 7 forming a longitudinal axis 7'.

A spring-biased 8 bolt carrier assembly 9 (also known as BCG) with bolt 9' is provided in the upper receiver 1 and is formed to slidably reposition 10 in longitudinal alignment 11 with the longitudinal axis 7' of barrel 5, from a chambered 10' position 8' with the bolt 9' engaging the chamber 4 at the first end 6 of barrel 5 at the second end 2' of upper receiver 1, to a recoiled 10" position 8" with the bolt spaced from the first end 6 of barrel 5, with the bolt carrier assembly 9 at the first 2 end of upper receiver 1.

For gas-operated carbines such as the AR15, M16 or the like, a gas tube 5' is utilized as part of its operation, the gas tube being generally longitudinally situated along the top of the barrel 5, the gas tube 5' having first and second ends, the second end provided to receive gas from the rifled bore 14 of barrel 5 via gas port 13 or the like, the first end providing flow of gas from discharged rounds in the rifle bore via gas port, through the gas tube 5', to the upper receiver 1.

Figure 4:
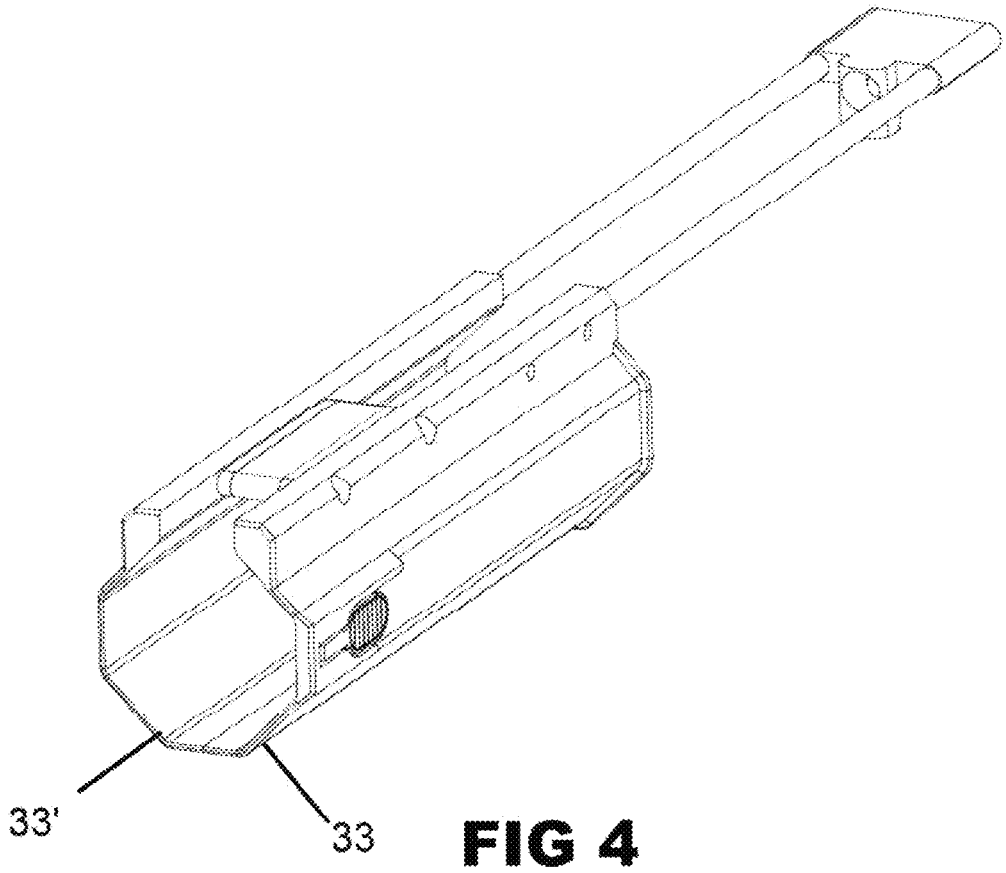
FIG. 4 is a forward, perspective view of the charging handle, drive stem and BCG catch of the invention of FIG. 3, shown in assembled form.
Figure 5:
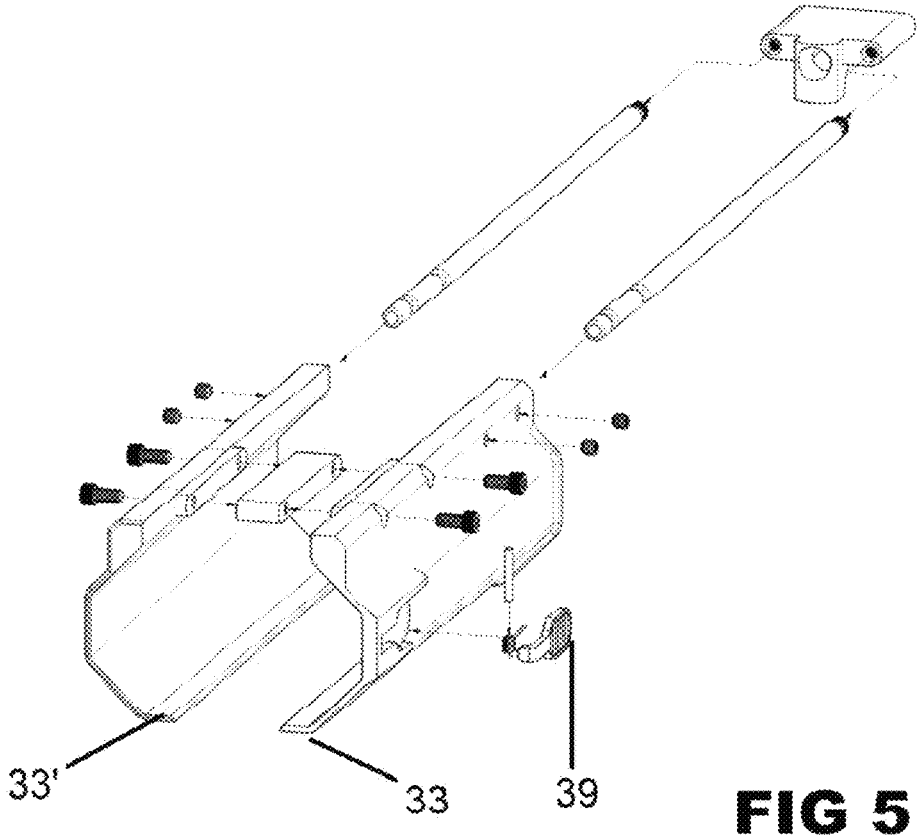
FIG. 5 is a forward, perspective, exploded view of the invention of FIG. 4.

Continuing with FIGS. 1-7, the preferred embodiment of the present invention I comprises a unique combination of a charging handle 17 and hand guard 25 which, in combination, is utilized to provide a pump-style charging action to the firearm F, as will be further discussed herein. The handguard 25 of the present invention as shown is specially configured for the present application, and replaces any prior handguard or forward stock which may have previously been mounted to firearm F.

The handguard 25 comprises an elongated main body B having a first 26 and second 26' ends having formed through its length a main passage 25' for receiving the barrel 5 and any gas tube 5' mounted thereto for the firearm F to which it is mounted, the handguard 25 further having a length 28, top 28', first 27 and second 27' sides, and bottom 28". First 30 and second 30' drive stem support tabs, each having drive stem passages 31, 31', respectively are situated at the first 27 and second 27' sides, respectively, of hand guard 25, at or near the first 26 end of hand guard 25.

As shown, the top 28' of the handguard 25 is spaced or elevated 35 away from the main body B via first 24 and second 24' extension walls, respectively emanating therefrom, which extension walls 24, 24' are parallel and equilaterally-spaced 35' relative to one another along main body B, the space 35' between first 24 and second 24' extension walls forming a secondary passage 24" therebetween. A rail mount 25" is shown situated provided along the top 28' of the handguard 25.

The charging handle 17 comprises first 18 and second 18' side panels 18, 18' respectively, which are situated in opposing, spaced relationship at opposing sides 27, 27' of handguard 25 respectively, as well as (in the present example) having bottom edges extending toward one another via first 33 and second 33' lower extensions, respectfully, so as to slidably envelope the underside or bottom 28" of handguard 25, said side panels 18, 18' joined via connection tab 19, the side panels 18, 18' when installed being situated about, while slidably reciprocating (via connection tab 19) along the length of handguard 25.

As shown connection tab 19 is a connection member formed to join first 18 and side 18' side panels in spaced relationship to one another in forming charging handle, providing a slidable engagement about handguard 25, which is fastened via threaded fasteners 36, 36', respectively.

Connection tab 19 slidably engages, is supported by and passes through first and second charging handle slots 32, 32' formed through first 24 and second 24' sidewalls respectively, said first and second charging handle slots 32, 32' having a width to receive the connection tab, said slots 32, 32' each further having a length 34 sufficient to provide sufficient reciprocation 37 for charging the bolt of firearm, said slots 32, 32' further longitudinally aligned with one another as well as the longitudinal axis 7' of the handguard 25 as well as the barrel 5 of firearm F.

Spring 38 biased (via retaining pin 38') release clip 39 having a pivotal catch 40 is mounted to first side panel 18, the catch formed to pivot via retaining pin to selectively engage (via spring bias) or disengage (via pressing release clip) locking aperture 41 formed in the side of handguard 25, so as to selectively lock or unlock the sliding/charging functionality in charging handle.

First 45 and second 45' drive stems, each having first 46 and second 46' ends, the first 46 end being threaded 46" are provided, the first 46 ends of drive stems 45, 45' threadingly engaging threaded apertures 50, 50' of BCG interface 48, respectively, which BCG interface 48 comprises a catch 49 for engaging the bolt carrier assembly 9 (BCA) or group (BCG) situated in the 1 upper receiver of firearm F.

The second end 46' of drive stems 45, 45' are formed to pass through the earlier referenced drive stem passages 31, 31' formed in first 30 and second 30' drive stem support tabs, respectively, so as to provide sliding engagement of same. The second ends 46' of drive stems 45, 45' comprises grooves 44, 44' respectively, spaced to receive set screws 51, 51' so as to engage same to side panels 18, 18' via drive stem passages 52, 52', respectively.

In use, the handguard 25 is mounted to the firearm F, with the forward charging handle 17 with side panels 18, 18', drive stems 45, 45', and BCG interface mounted as discussed so that the BCG catch 49 engages bolt carrier assembly 9.

If the pivotal catch 40 is engaged so as to lock the charging handle in position about handguard 25 via catch 40 engaging locking aperture 41, the user presses release clip 39 to pivot catch 40 to release the charging handle 17. The user then grasps the side panels 18, 18' forming the charging panel and pulls 53 same towards upper receiver 1, allowing BCG catch 49 to engage bolt carrier assembly 9 to fully retract from the firing chamber 4 at the first end 6 of barrel 5, then allows spring bias via spring 8 to return 53' bolt carrier assembly back to its position adjacent to firing chamber 4, along with forward charging handle including BCG interface to the previous position.

The present invention thereby provides a useful and effective system to forward charge a carbine or the like having a gas tube. As such a gas tube is typically situated along the top of the barrel within the handguard, the present invention provides the drive stem(s) so as to be situated exterior the handguard. In the present exemplary embodiment, as discussed above, the first and second drive stems being situated along opposing sides of the handguard, respectively.

Alternative Embodiment for Firearms without Gas Tube

Figure 8:
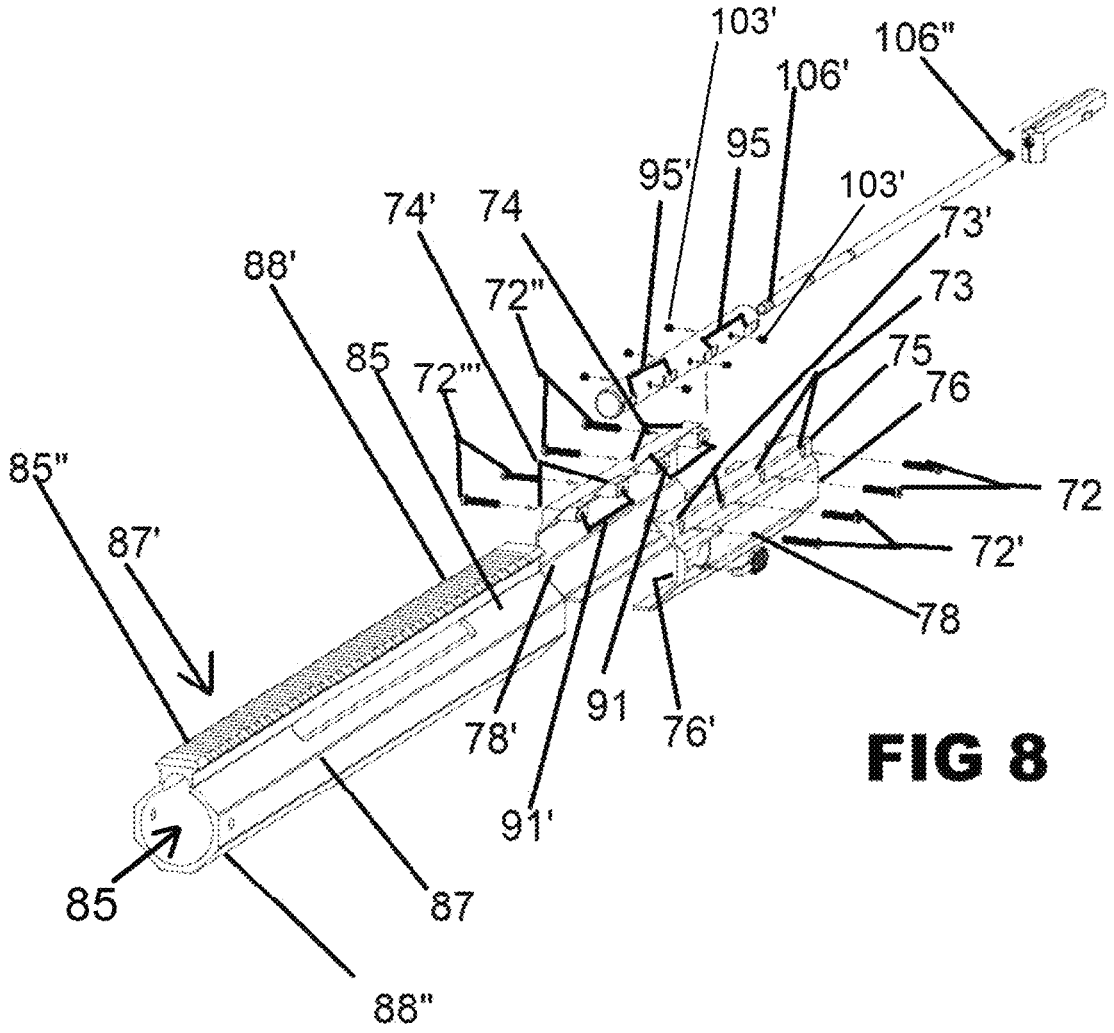
Figure 9:
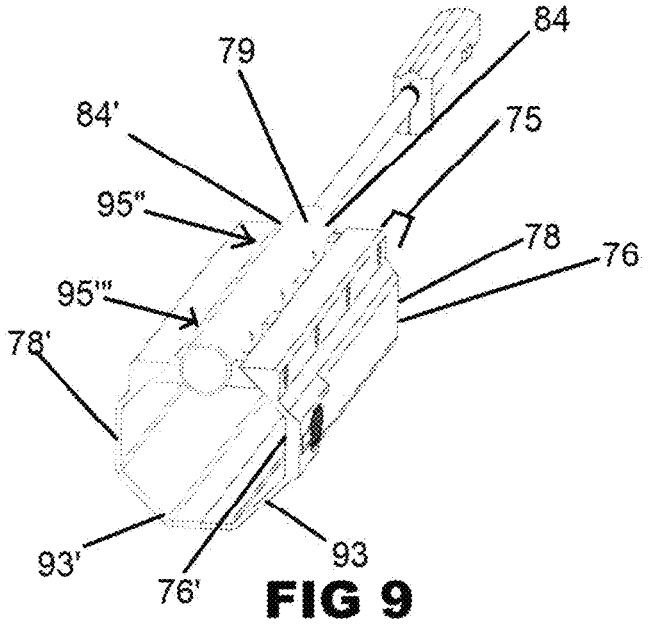
FIG. 9 is forward, perspective view of the assembled charging handle, drive stem and BCG catch of the invention of FIG. 8.
Figure 10:
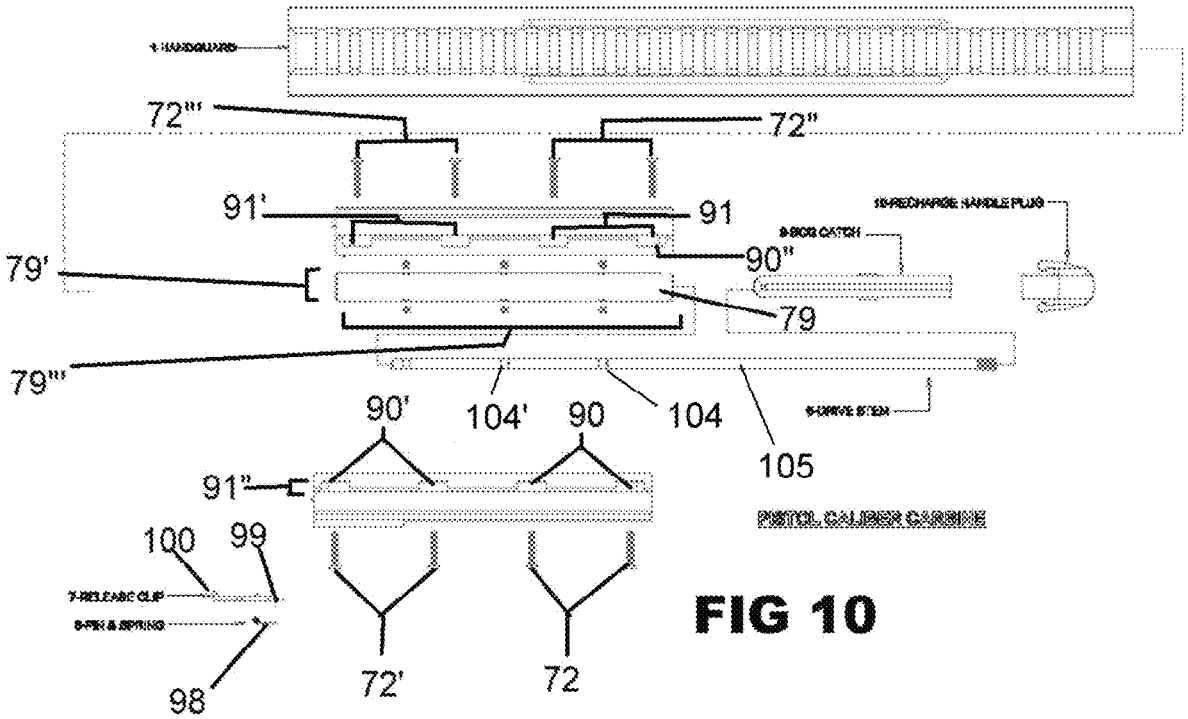
FIG. 10 is a top, exploded view of the invention of FIG. 8.
Figure 11:
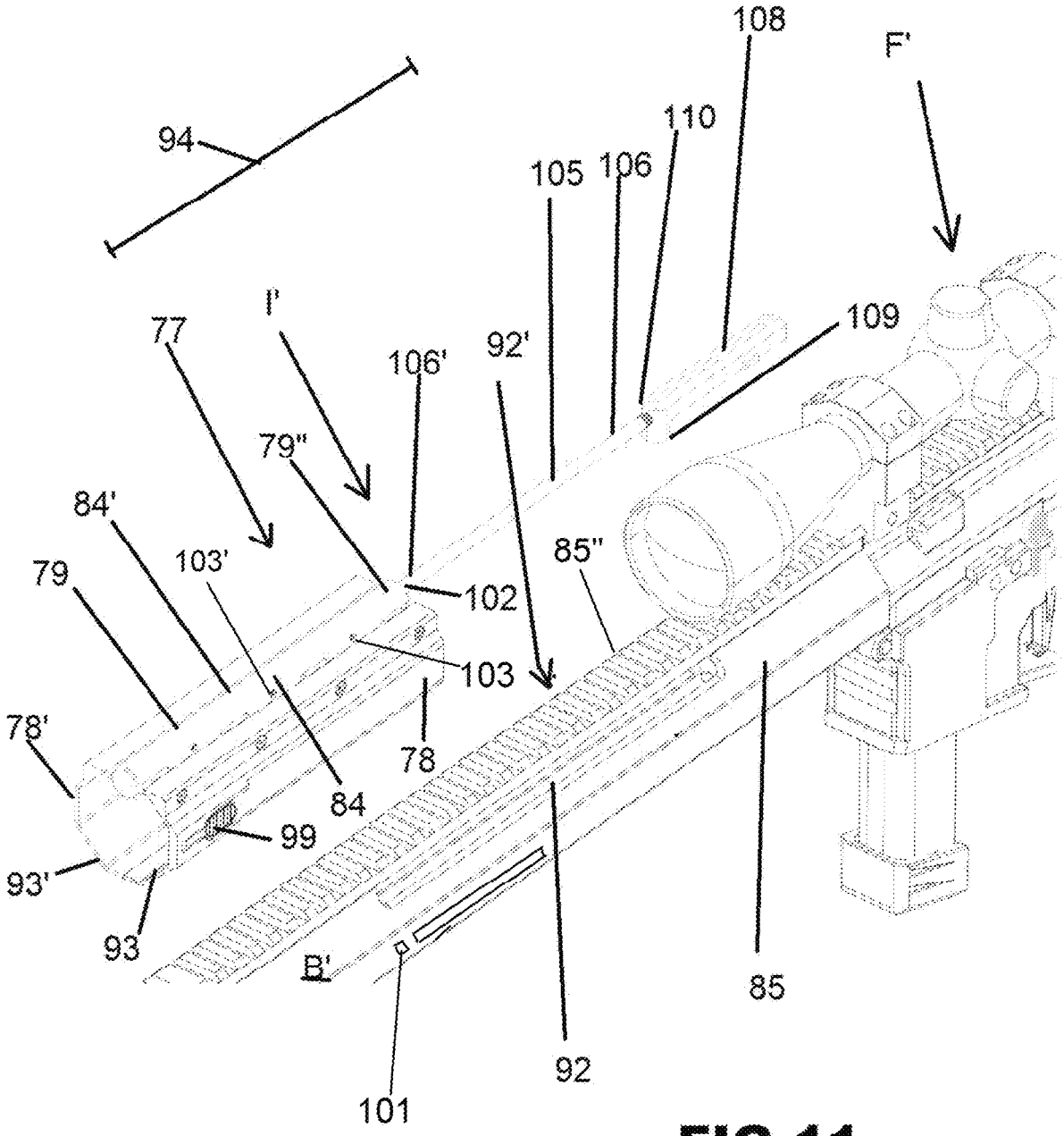
FIG. 11 is a forward, partial, perspective view of the invention of FIG. 10, illustrating the handguard applied to a pistol carbine, with the charging handle, drive stem and BCG catch of the present invention illustrated separately, prior to installation.
Figure 12:
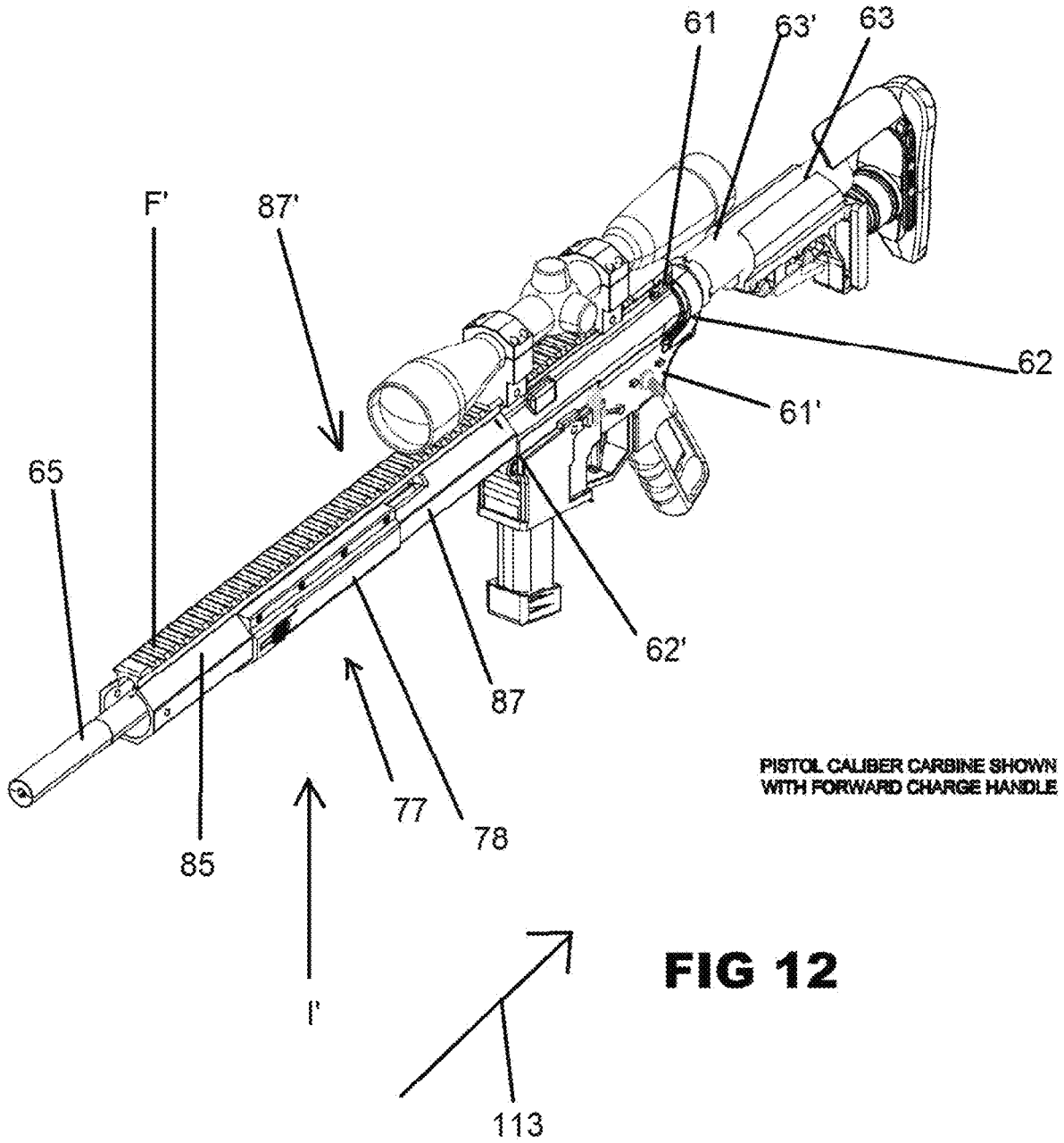
FIG. 12 is a forward, perspective view of the in charging handle, drive stem and BCG catch of the invention of FIG. 11 shown in assembled form on a pistol caliber carbine.
Figure 13:
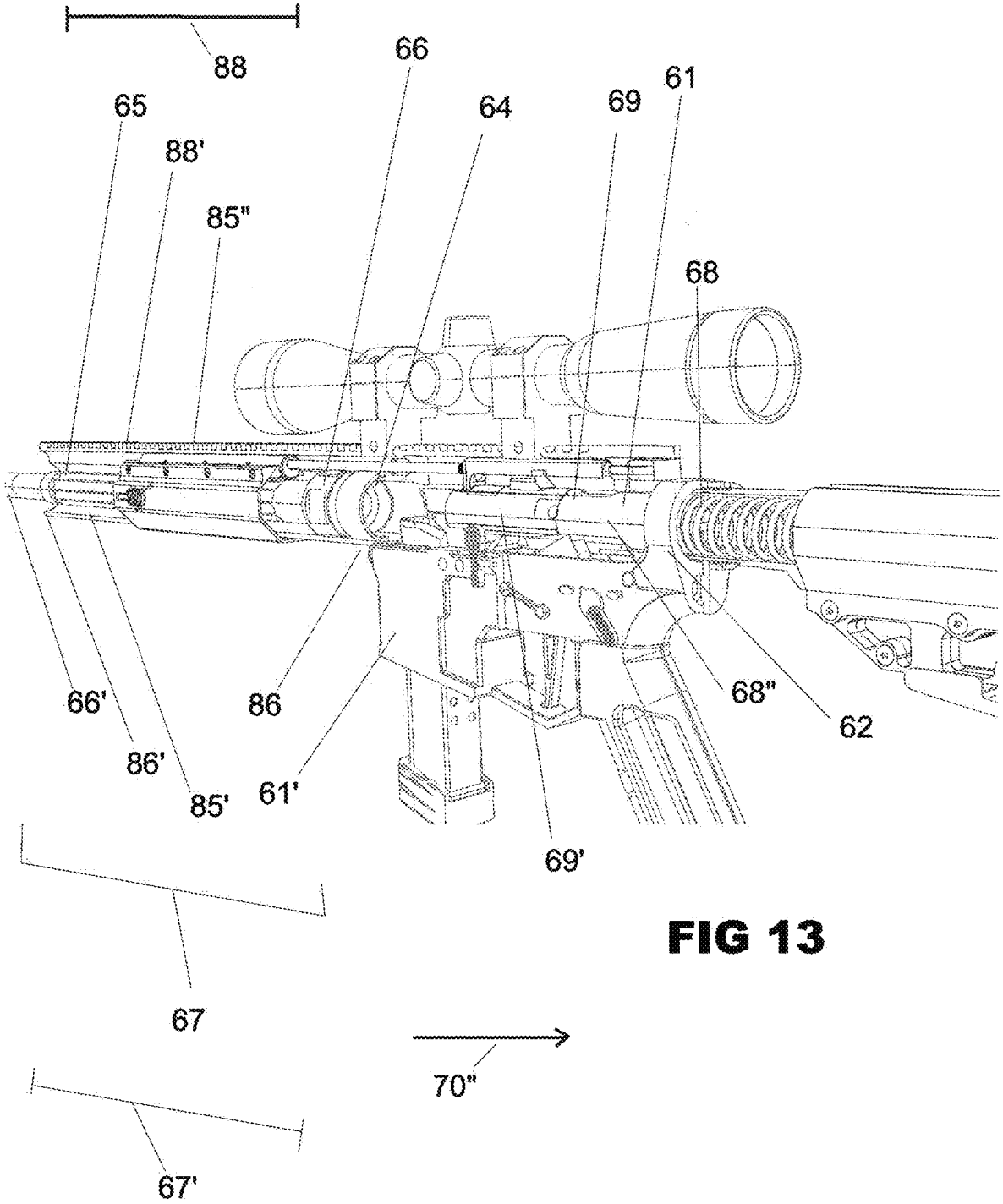
FIG. 13 is a side view of the invention of FIG. 12 in assembled form in use, showing movement of the charge train during the recharge cycle, wherein the bolt is positioned to its fully retracted position.
Figure 14:
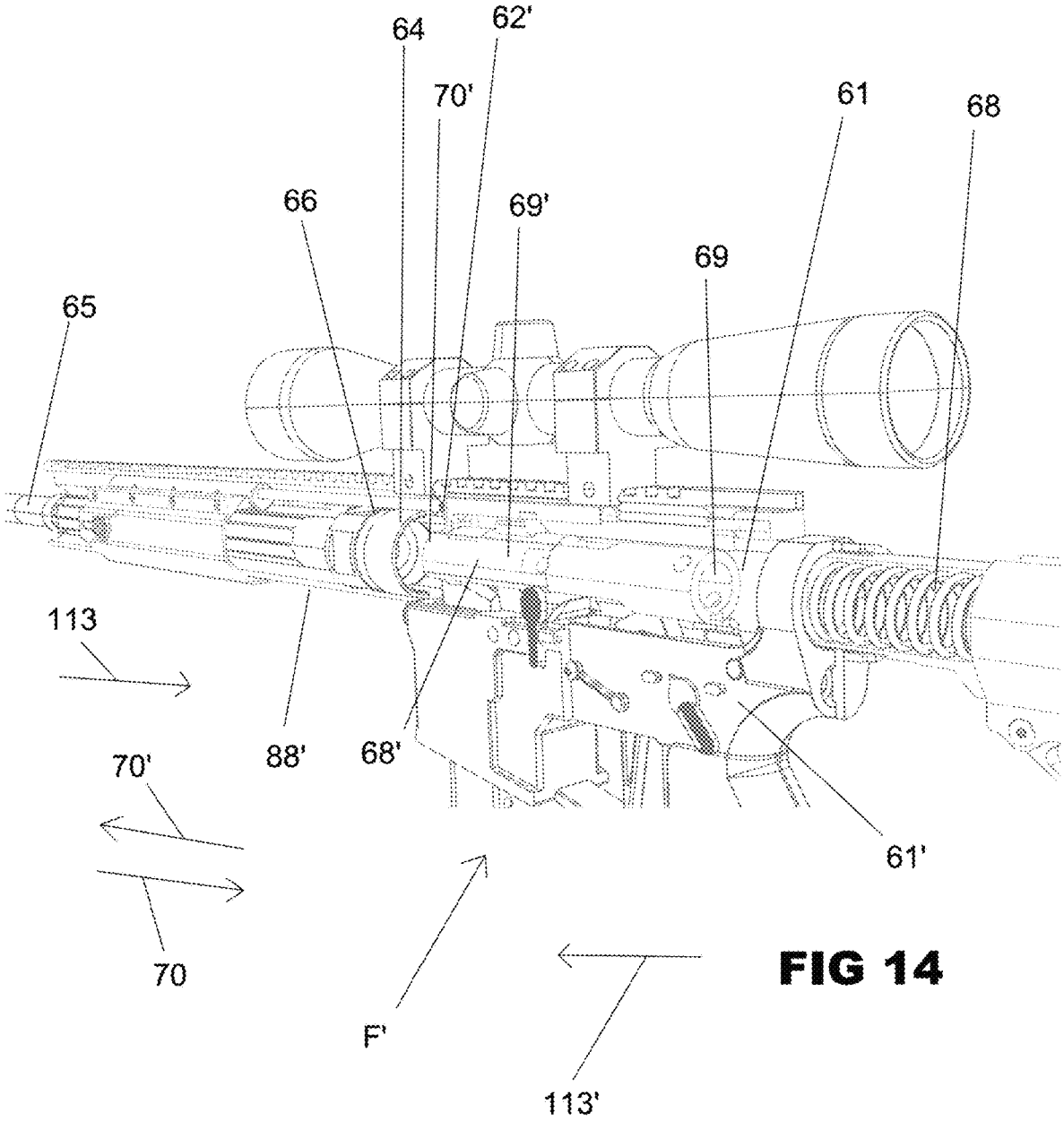
FIG. 14 is a side view of the invention of FIG. 13, but instead showing movement of the charge train from the fully retracted position, urged via spring bias to the fully charged position with the bolt at the chamber.

FIGS. 8-14 illustrate an alternative embodiment of the invention of FIGS. 1-7, particularly suitable for firearms, such as pistol caliber carbines or the like.

Unlike firearms requiring a gas tube such as with the first embodiment, the present, alternative embodiment requires no gas tube, so the present invention can utilize the empty space provided above the barrel within the handguard to situate the drive stem, thereby enclosing the drive stem within the handguard. Other features of the present, alternative embodiment are similar to that of the first embodiment, as will be detailed below.

Referring to FIGS. 8-14, the alternative embodiment I' of the present invention is configured for mounting to and use with, for firearms F' NOT having a gas tube such as pistol caliber carbines, such as 9 mm, 38 cal, etc, the firearm F' illustrated having a lower receiver 61' and upper receiver 61, each receiver having first 62, 62' and second ends, the first end 62 of lower receiver 61' having mounted thereto the tang or buffer tube 63' for a rear stock 63 (or other configuration, depending on type), the second end 62' of upper receiver 61 engaging a firing chamber 64 at the first end 66 of a barrel 65, the barrel 65 further comprising a second end 66' and a length 67 forming a longitudinal axis 67'.

A spring-biased 68 bolt carrier assembly 69 (also referenced as a BCG) with bolt 69' is provided in the upper receiver 61 and is formed to slidably reposition 70 in longitudinal alignment with the longitudinal axis 67' of barrel 65, from a chambered 70' position 68' with the bolt 69' engaging the chamber 64 at the first end 66 of barrel 65 at the second end 62' of upper receiver, to a recoiled 70" position 68" with the bolt carrier assembly 69 with bolt 69' spaced from the first end 66 of barrel 65, with the bolt carrier assembly 69 at the first 62 end of upper receiver 61.

Continuing with the Figures, the present embodiment of the invention I' comprises a combination of a charging handle 77 and handguard 85 which, as with the preferred embodiment, in combination, is utilized to provide a pump-style charging action to the firearm F', but having different placement of the drive mechanism and as will be further discussed herein. The handguard 85 of the present invention as shown is specially configured and replaces any prior handguard or forward stock which may have previously been mounted to firearm F'.

The handguard 85 comprises an elongated main body B' having a first 86 and second 86' ends, the handguard further having formed through its length a main passage 85' for receiving the barrel 65 for the firearm F' to which it is mounted, the handguard 85 further having a length 88, top 88', first 87 and second 87' sides, and bottom 88". A rail mount 85" is shown situated provided along the top 88' of the handguard 85.

Handguard 85 has formed therein first and second charging handle slots 92, 92', forming an elongated opening through each of said first 87 and second 87' sidewalls respectively, said first and second charging handle slots 92, 92' having a length 94 sufficient to provide adequate reciprocation for charging the firearm, said slots 92, 92' further longitudinally aligned with one another as well as the longitudinal axis 67' of the handguard 85 as well as the barrel 65 of firearm F'.

The charging handle 77 is comprised of first and second side panels 78, 78' respectively, which are situated in opposing, spaced relationship at opposing sides 87, 87' of handguard 85 respectively, and are configured to envelope the sides of handguard. Further, side panels 78, 78' have bottom edges extending toward one another via first 93 and second 93' lower extensions, respectfully, so as to slidably envelope the underside or bottom 88" of handguard 85 as well.

Side panels 78, 78' each comprise outer 76 and inner 76' walls, and an upper section 75 through which there is formed fastener passages 73, 73' and 74, 74' respectively, along each panel's length. Each fastener passage extends through each panel and extends from the inner wall of each side panel via dowels 90, 90', and 91, 91' emanating therefrom, each dowel having a length 91" and free end 90" extending therefrom, each dowel having the respective extended fastener passage running therethrough.

A connection tube 79 is provided having a length 79", width 79', first 79" and second ends and first 84 and second 84' sides, each side having one or more threaded passages 95, 95' and 95", 95'" situated along opposing sides respectively, each threaded passage spaced to align with respective fastener passages at the free ends of dowels engaging same, respectively.

The connection tube 79 forms a connection member and is slidably situated in main passage 85' of handguard 85, above barrel 65, so that the opposing threaded passages 95, 95' and 95", 95" of connection tube are aligned to face handle opposing slots 92, 92' respectively, so that the free ends 90" of dowels 90, 90' and 91, 91' respectively are positioned to pass through slots 92, 92' so that threaded fasteners 72, 72' and 72", 72" are used to fasten opposing side panels 78, 78' thereto.

First 78 and second 78' side panels are positioned in opposing, spaced relationship to one another to form the charging handle about the handguard 85, providing a slidable engagement about handguard 85, via the dowels emanating from the inner walls of said side panels 78, 78', and through said slots 92, 92' respectively to fasten same to opposing sides of said connection tube 79 situated within hand guard.

Said first 78 and second 78' side panels, having engaged said connection tube 79 via their respective dowels 90, 90' and 91, 91' respectively, thereby slidably engages, is supported by said hand guard via said slots 92, 92'.

Spring 98 biased release clip 99 has a pivotal catch 100 and is mounted to first side panel 78, the catch 100 formed to pivot to selectively engage (via spring bias) or disengage (via pressing release clip) a locking aperture 101 formed in the side of hand guard, so as to selectively lock or unlock the sliding/charging functionality in charging handle.

Drive stem 105 has first 106 and second 106' ends, the first 106 end being threaded 106", is provided, the first 106 end threadingly engaging threaded aperture 110 of BCG interface 108, which comprises a catch 109 for engaging the bolt carrier group (BCG) 69 (also known as bolt carrier assembly, i.e., BCA) situated in the upper receiver 61 of firearm F'.

The second end 106' of drive stem 105 engages aperture 102 at the first end 79" of connection tube 79 to the drive stem via fasteners 103, 103' seated in groove 104, 104', respectively, in drive stem 105, thereby linking the connection tube/side panels via the slots formed in the handguard.

In use, the handguard 85 is mounted to the firearm F', with the forward charging handle 77 with side panels 78, 78' engaging connection tube 79 via handguard slots 92, 92' the connection tube 79 linked to BCG interface mounted as discussed, via drive stem, so that the BCG catch engages bolt carrier assembly 69.

If the pivotal catch 100 is engaged so as to lock the charging handle in position about handguard 85, the user presses release clip 99 to pivot catch 100 to release the charging handle 77 (formed by opposing side panels 78, 78'). The user then grasps the opposing side panels 78, 78' and pulls 113 same towards upper receiver 61, allowing BCG catch 109 to engage bolt carrier assembly 69 to fully retract from the firing chamber 64 at the first end 66 of barrel 65, then allows spring bias via spring 68 to return 113' bolt carrier assembly back to its position adjacent to firing chamber 64, along with forward charging handle including BCG interface to the previous position.

The present invention thereby provides a useful and effective system to forward charge a carbine or the like without a gas tube, as a gas tube would typically be situated along the top of the barrel within the handguard (where the drive stem of the present embodiment is located), which would interfere with such a configuration.

ELEMENTS of the INVENTION

I,' preferred, alternative embodiment of invention
F,' firearm
B,' main body of handguard 25
1,' upper, lower receiver
2,' first, second ends
3,' stock, buffer tube
4 firing chamber
5,' barrel, gas tube
6,' first, second ends
7,' length, longitudinal axis
8,','' spring biased, chambered, recoiled position
9,' bolt carrier assembly or group (BCG), bolt
10,','' reposition, chambered, recoiled
11 longitudinal alignment
13 gas port
14 rifle bore
17 forward charging handle
18,' first and second side panels
19 connection tab
24,','' first, second extension/sidewalls, secondary passage
25,',' handguard, main passage, rail mount
26,' first, second ends
27,' first, second sides
28,','' length, top, bottom
30,' drive stem support tabs
31,' drive stem passages
32,' first, second slots for charging handle
33,' first, second lower extensions
34 length
35,' elevated, spaced
36,' threaded fasteners for tab 19
37 reciprocation
38,' spring, retaining pin
39 release clip
40 pivotal catch
41 locking aperture
44', grooves to receive set screws
45,' drive stems
46,','' first, second, ends, threaded ends
48 BCG interface
49 BCG catch
50,' BCG drive stem threaded apertures
51,' drive stem set screws
52,' drive stem apertures
53,' pulls, returns
61,' upper, lower receiver
62,' first, second ends
63,' stock, tang or buffer tube
64 firing chamber
65 barrel
66,' first, second ends
67,' length, longitudinal axis
68,','' spring biased, chambered, recoiled position
69,' bolt carrier assembly, bolt
70,','' reposition, chambered, recoiled
72,','',''' fasteners
73,' fastener passages
74,' fastener passages
75 upper edge/section
76,' outer, inner walls side panels
77 forward charging handle
78,' first and second side panels
79,','',''' connection tube, width, first end. length
84,' first second sides connection tube
85,','' handguard, main passage, rail mount
86,' first, second ends
87,' first, second sides
88,','' length, top, bottom
90,','' dowels, free end
91,','' dowels, length
92,' first, second slots for charging handle
93,' first, second lower extensions
94 length
95,','',''' connection tube fastener passages
98 spring
99 release clip
100 pivotal catch
101 locking aperture
102 connection tube end aperture for drive stem
103,' set screws for setting drive stem
104,' grooves to receive set screws
105 drive stem
106,','' first, second, ends, threaded ends
108 BCG interface
109 BCG catch
110 BCG drive stem threaded apertures
113,' pulls, returns The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense. Accordingly, the use of various terms herein such as, but not limited to, "tab" and/or "tube" should not be considered limiting as to any particular configuration, except as specifically described herein.

I claim:

1. An apparatus for charging an automatic or semi-automatic firearm having a barrel having an opening, a receiver, and bolt carrier assembly, comprising:

a handguard enveloping at least a portion of said barrel, said handguard having first and second opposing sides, a bottom, and a length;

first and second slots associated with the first and second sides, respectively, of said handguard, said slots aligned with said lengths of said handguard;

first and second side panels formed to envelop said first and second opposing sides of said handguard, respectively;

a connection member situated in said handguard above said barrel, said connection member affixed to said first and second side panels via said first and second slots, respectively, so as to facilitate sliding engagement of said first and second side panels along the length of said slots, said connection member having first and second ends, and a length;

a first drive stem having first and second ends and a length, said second end of said first drive stem engaging at least one of said first and second side panels via said first end of said connection member, said first end of said first drive stem engaging without being affixed to a bolt carrier assembly associated with said firearm via a BCG interface;

wherein said connection member is cylindrical;

whereby, upon grasping said first and second side panels and slidingly urging same along said barrel towards said receiver, said bolt carrier assembly is pushed by said BCG interface to fully retract from said chamber; and whereby, upon releasing said first and second side panels after said bolt carrier assembly is fully retracted, a spring bias is provided to return said bolt carrier assembly back to its a position adjacent said chamber, as well as said first drive stem with BCG interface, to a previous position; and whereby said bolt carrier assembly is formed to cycle away from said firing chamber upon discharge of said firearm independent of said BCG interface and associated first drive stem.

2. The apparatus of claim 1, wherein there are further provided dowels situated through said first and second slots, and between said side panels and said connection member, respectively.

3. The apparatus of claim 2, wherein said BCG interface further comprises a catch formed to releasably engage said bolt carrier assembly of said firearm, and wherein said first drive stem is situated at least partially within said handguard.

4. The apparatus of claim 3, wherein there is provided a locking retainer clip mounted to said first side panel, said locking retainer clip comprising a catch formed to engage said handguard to selectively lock said side panel in place.

5. The apparatus of claim 4, wherein said connection member has a cylindrical configuration comprising a tube.

6. A method of charging an automatic or semi-automatic firearm having a barrel having a chamber, a receiver, and a bolt, comprising:

a. enveloping at least a portion of said barrel of said firearm with a handguard having first and second opposing sides, a bottom, and a length, said first and second sides having formed therein first and second slots, respectively, said slots aligned with said length of said firearm;

b. providing first and second side panels formed to envelop said first and second opposing sides of said handguard, respectively;

c. connecting said first and second side panels via said first and second slots using a connection member having a length forming first and second ends, said length of said connection member situated in said handguard above said barrel, so as to facilitate sliding engagement of said first and second side panels along the length of said slots, wherein said connection member is cylindrical;

d. providing a drive stem having first and second ends, said second end of said drive stem engaging one or both of said first and second side panels via said first end of said connection member, said first end of said drive stem formed to selectively contact without being fixedly attached to said bolt via a BCG interface;

e. charging said firearm, comprising the steps of grasping said side panels and sliding same along said hand guard to urge said first end of said connection member to urge said drive stem toward said receiver via said slots, so that said first end of said drive stem engages said BCG interface to push said bolt away from said chamber so as to fully retract from same, providing a retracted bolt; and f. utilizing a spring-bias to urge said retracted bolt back to said chamber, so as to charge said firearm;

g. firing said firearm, so as to facilitate said bolt to cycle away from said chamber independent of said BCG interface.

7. The method of claim 6, wherein in step "d." there is further provided a catch emanating from said BCG interface, and wherein in step "e.", said catch of said BCG interface is formed to selectively contact said bolt to push said bolt away from said chamber upon the application of force thereto via said drive stem.

8. The method of claim 7, wherein after step "f" there is provided the added step "f(i)" of utilizing said spring bias to reposition said BCG interface via said retracted bolt to a position adjacent to said chamber.

9. The method of claim 8, wherein after step "d" there is provided the added step "d(i)" of provided a locking retainer clip mounted to said first or second side panels, said locking retainer clip comprising a catch formed to selectively lock said first and second side panel(s) in place and selectively prevent charging of said firearm.

10. The method of claim 9, wherein in step "f(i)" there is provided the added step "f(ii)" of engaging said locking retainer clip to selectively lock said first and second side panels in place, providing locked first and second side panels.

* * * * *